US011678736B2

(12) United States Patent
Stegherr et al.

(10) Patent No.: US 11,678,736 B2
(45) Date of Patent: Jun. 20, 2023

(54) BELT ADAPTER AND HOLDING SYSTEM COMPRISING A BELT ADAPTER AND A CARRIER ELEMENT

(71) Applicant: BS Systems GmbH & Co. KG, Zusmarshausen (DE)

(72) Inventors: Franz Stegherr, Stadtbergen (DE); Georg Dexle, Kötz (DE)

(73) Assignee: BS Systems GmbH & Co. KG, Zusmarshausen (DE)

( * ) Notice: Subject to any disclaimer, the term of this patent is extended or adjusted under 35 U.S.C. 154(b) by 144 days.

(21) Appl. No.: 17/179,568

(22) Filed: Feb. 19, 2021

(65) Prior Publication Data

US 2021/0259397 A1 Aug. 26, 2021

(30) Foreign Application Priority Data

Feb. 20, 2020 (DE) ..... 10 2020 104 512.3

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC .... A45F 2005/026; A45F 5/021; Y10S 24/60; Y10T 24/4501; Y10T 24/1391;
(Continued)

(56) References Cited

U.S. PATENT DOCUMENTS 3,743,372 A 7/1973 Ruggerone
3,759,411 A 9/1973 Horvath
(Continued)

FOREIGN PATENT DOCUMENTS

DE 7244356 U 5/1974
DE 4009960 A1 10/1990
(Continued)

OTHER PUBLICATIONS

For U.S. Appl. No. 16/317,234: Response to Final Office Action filed Apr. 29, 2021 Notice of Allowance dated May 10, 2021.
(Continued)

*Primary Examiner* — Adam J Waggenspack
(74) *Attorney, Agent, or Firm* — Paul D. Bianco; Katharine David Wong; Fleit Intellectual Property Law

(57) ABSTRACT

A belt adapter for attaching objects to a belt includes a holding system for attaching the belt adapter to the belt, an opening extending along a vertical axis of the belt adapter, through which opening a carrier element can be inserted into the belt adapter, and a securing element which can be moved between an unlocked position, in which the carrier element can be inserted into and removed from the belt adapter, and a locked position for securely holding a carrier element inserted into the belt adapter in a locked position. A holding system comprises a belt adapter and a carrier element. The belt adapter ensures that the carrier element is reliably and securely held in place in that the securing element is designed to receive at least part of the carrier element and is movably guided along the vertical axis between the unlocked and locked positions.

16 Claims, 7 Drawing Sheets

(58) Field of Classification Search
CPC ..... Y10T 24/1394; Y10T 24/45089; E05B 65/48; E05B 65/52; E05B 65/5284
USPC ..... 224/269, 271–272, 667
See application file for complete search history.

(56) References Cited

U.S. PATENT DOCUMENTS 3,888,350 A 6/1975 Horvath
4,122,925 A 10/1978 Schultheiss
4,126,224 A 11/1978 Laauwe
4,216,857 A 8/1980 Huang
4,243,279 A 1/1981 Ackeret
4,353,473 A 10/1982 Morris
4,364,488 A 12/1982 Anjou
4,426,056 A 1/1984 Gelardi et al.
4,431,237 A 2/1984 Saito et al.
4,457,433 A 7/1984 Wilson
4,643,494 A 2/1987 Marleau
4,671,943 A 6/1987 Wahlquist
D292,634 S 11/1987 Chabot
4,820,499 A 4/1989 Taschner
4,842,142 A 6/1989 Kreeger
5,101,969 A 4/1992 Umiker
5,176,281 A 1/1993 Fiore
D340,353 S 10/1993 Benarrouch
5,274,885 A * 1/1994 Hellweg ..... A45F 5/02 24/3.12
5,347,693 A * 9/1994 Otrusina ..... A45F 5/02 24/3.12
5,379,887 A 1/1995 Conley, Jr.
D355,764 S 2/1995 Apps
D356,211 S 3/1995 Apps
D356,679 S 3/1995 Apps
5,429,235 A 7/1995 Chen
D360,757 S 8/1995 Snetting
D361,663 S 8/1995 Kalin
5,445,273 A 8/1995 Apps
5,495,945 A 3/1996 Apps
5,850,996 A * 12/1998 Liang ..... A45F 5/02 248/221.11
5,890,613 A 4/1999 Williams
D416,682 S 11/1999 Tanji
5,979,654 A 11/1999 Apps
6,006,969 A * 12/1999 Kim ..... A45F 5/021 224/272
6,082,539 A 7/2000 Lee
6,098,858 A * 8/2000 Laugesen ..... A45F 5/02 24/578.11
D439,408 S 3/2001 Gibson
6,250,730 B1 6/2001 Roth et al.
D446,015 S 8/2001 Apps
6,286,737 B1 * 9/2001 Whitley ..... H04W 88/02 24/3.12
D448,567 S 10/2001 Buss
D452,613 S 1/2002 Hammett
D462,522 S 9/2002 Apps
D470,658 S 2/2003 Chunn
D478,421 S 8/2003 Overholt et al.
D483,946 S 12/2003 Koefelda
D487,634 S 3/2004 Apps et al.
6,786,372 B2 * 9/2004 Enkerlin ..... A45F 5/02 455/100
6,874,634 B2 4/2005 Riley
6,880,869 B2 4/2005 Schainholz
6,889,838 B2 5/2005 Meier et al.
7,000,287 B2 2/2006 Valentini
7,032,791 B2 * 4/2006 Stotts ..... A45F 5/021 224/269
D520,237 S 5/2006 Cheng
D520,734 S 5/2006 Henning et al.
D524,651 S 7/2006 Perret
D539,541 S 4/2007 Stahl
D542,529 S 5/2007 Peart et al.
D557,011 S 12/2007 Fernandez et al.
D572,479 S 7/2008 Buck
D595,958 S 7/2009 Twig
D598,684 S 8/2009 Stahl
7,573,385 B2 8/2009 Tonelli
D600,015 S 9/2009 Wenchel
D601,797 S 10/2009 Wenchel
D608,094 S 1/2010 Concari
D616,200 S 5/2010 Riedel et al.
D620,255 S 7/2010 Chang
D630,435 S 1/2011 Brunner
7,971,762 B2 * 7/2011 Clifton, Jr. ..... F41C 33/041 224/663
8,061,492 B2 11/2011 Riedel et al.
8,186,534 B2 5/2012 Apps
D668,867 S 10/2012 Yamamot
8,403,438 B2 3/2013 Park
D688,869 S 9/2013 Lindstrom
8,522,967 B2 9/2013 Lindstrom
8,590,704 B2 11/2013 Koenig et al.
8,677,661 B2 3/2014 Michels et al.
D704,442 S 5/2014 Chen
8,827,127 B2 * 9/2014 Rekuc ..... A45F 5/00 224/183
D719,352 S 12/2014 Shitrit
8,919,623 B1 12/2014 Bergeron
9,027,212 B2 * 5/2015 Wu ..... G03B 17/561 24/3.12
D738,106 S 9/2015 Shitrit
9,131,770 B2 9/2015 Stegherr
D750,890 S 3/2016 Quehl
D757,435 S 5/2016 Damberg
D759,975 S 6/2016 Zozin
D785,938 S 5/2017 Ou
D790,221 S 6/2017 Yahav
D792,708 S 7/2017 Tazawa
D798,053 S 9/2017 Shitrit
D801,685 S 11/2017 Meng
D808,653 S 1/2018 Rayeski
D811,084 S 2/2018 Ballou
RE47,022 E 9/2018 Sosnovsky
D833,743 S 11/2018 Tonelli
D841,981 S 3/2019 Kogel
D841,982 S 3/2019 Kogel
D841,983 S 3/2019 Wang
10,292,459 B2 * 5/2019 Lau ..... A44B 13/02
10,405,626 B2 9/2019 Gonitianer
D872,471 S 1/2020 Zhao
D873,004 S 1/2020 Shpitzer
D882,952 S 5/2020 Austin
10,703,534 B2 6/2020 Brunner
10,710,770 B2 7/2020 Kogel
10,829,269 B2 11/2020 Gonitianer
10,870,513 B2 12/2020 Gonitianer
D918,580 S 5/2021 Kogel
11,044,976 B1 6/2021 Debro
11,072,461 B2 7/2021 Gonitianer
2002/0132592 A1 * 9/2002 Fan ..... A45F 5/021 455/575.1
2003/0094392 A1 5/2003 Meier et al.
2003/0102970 A1 6/2003 Creel et al.
2003/0141326 A1 7/2003 Bennett
2003/0141329 A1 7/2003 Huang
2003/0162510 A1 * 8/2003 Kim ..... A45F 5/02 455/575.1
2006/0049640 A1 3/2006 Lee
2006/0170558 A1 8/2006 Tonelli
2008/0067091 A1 3/2008 Chang
2008/0251396 A1 10/2008 Oh
2009/0236255 A1 9/2009 Piacenza et al.
2009/0256454 A1 10/2009 Landau
2010/0147642 A1 6/2010 Andochick
2010/0147732 A1 6/2010 Delagrange
2011/0121695 A1 5/2011 Purdy
2011/0139666 A1 6/2011 Sosnovsky et al.
2011/0147256 A1 6/2011 Atherton et al.
2011/0186397 A1 8/2011 Sheikh
2011/0233096 A1 9/2011 Michels et al.
2014/0062281 A1 3/2014 Stegherr
2014/0262885 A1 9/2014 Green et al.

(56) References Cited

U.S. PATENT DOCUMENTS

| | | | |
|---|---|---|---|
| 2016/0008972 | A1 | 1/2016 | Chen |
| 2016/0144500 | A1 | 5/2016 | Chen |
| 2016/0213115 | A1 | 7/2016 | Gonitianer et al. |
| 2017/0318927 | A1 | 11/2017 | Kraus et al. |
| 2018/0220758 | A1 | 8/2018 | Burchia |
| 2019/0291922 | A1 | 9/2019 | Gonitianer |
| 2019/0308772 | A1 | 10/2019 | Gonitianer |
| 2019/0315515 | A1 | 10/2019 | Gonitianer |
| 2020/0346819 | A1 | 11/2020 | Kögel |
| 2021/0139186 | A1 | 5/2021 | Kobayashi |

FOREIGN PATENT DOCUMENTS

| | | | |
|---|---|---|---|
| DE | 4107267 | A1 | 9/1992 |
| DE | 9314298 | U1 | 2/1994 |
| DE | 29723812 | U1 | 4/1999 |
| DE | 102006002475 | | 7/2006 |
| DE | 202005015040 | | 8/2006 |
| DE | 10 2007 032382 | A1 | 1/2008 |
| DE | 202012102760 | U1 | 12/2012 |
| DE | 10 2011 110207 | A1 | 2/2013 |
| DE | 20 2013 003741 | U1 | 4/2013 |
| DE | 202014101556 | U1 | 7/2014 |
| DE | 20 2014 103695 | U1 | 10/2014 |
| DE | 10 2013 110496 | A1 | 3/2015 |
| DE | 102013110496 | | 3/2015 |
| DE | 20 2015 005752 | U1 | 11/2016 |
| DE | 202015005752 | | 12/2016 |
| DE | 10 2016 112853 | A1 | 1/2018 |
| EP | 0555533 | A1 | 8/1993 |
| EP | 0997234 | A1 | 5/2000 |
| EP | 1 238 602 | A2 | 9/2002 |
| EP | 1238602 | A2 | 9/2002 |
| EP | 1516703 | A1 | 3/2005 |
| EP | 2020188 | A1 | 2/2009 |
| EP | 2703310 | A1 | 3/2014 |
| GB | 2459288 | | 10/2009 |
| WO | 2000/08882 | | 2/2000 |
| WO | 01/25701 | | 4/2001 |
| WO | 02/11955 | A1 | 2/2002 |
| WO | 2011/000387 | A1 | 1/2011 |
| WO | 2011/032568 | | 3/2011 |
| WO | 2016/091570 | A1 | 6/2016 |
| WO | 2017/001083 | A1 | 1/2017 |
| WO | 2018010857 | A1 | 1/2018 |
| WO | 2018010858 | A1 | 1/2018 |
| WO | 2018010859 | A1 | 1/2018 |

OTHER PUBLICATIONS

Australian Examination Report dated Mar. 18, 2021 for Australian Application No. 2021200186.
European Search Report dated Jun. 1, 2021 for European Application No. EP20 21 6276.
International Search Report, Written Opinion and International Preliminary Report on Patentability for PCT/EP2018/064742, filed Jun. 5, 2018.
Result of Examination Report for German Application No. 10 2017 128 493.1, filed Nov. 30, 2017.
Office Action dated Sep. 29, 2020 for U.S. Appl. No. 16/317,234.
Restriction Requirement Office Action dated May 19, 2020 for U.S. Appl. No. 16/317,234.
Response to Office Action filed Jul. 14, 2021 for U.S. Appl. No. 16/764,930.
Response to Office Action filed Jul. 15, 2020 for U.S. Appl. No. 16/317,175, filed Jan. 11, 2019.
For U.S. Appl. No. 16/317,234: Response to office action filed Dec. 29, 2020.
Office Action dated Apr. 14, 2021, for U.S. Appl. No. 16/764,930.
Notice of Allowance dated Mar. 15, 2021 for U.S. Appl. No. 29/679,432 (646).
Result of examination report for German Application No. 10 2013 110 496.7, filed Sep. 23, 2013.
Result of examination report of German Application No. 10 2017 117 823.6, filed Aug. 7, 2017.
International Search Report, Written Opinion and International Preliminary Report on Patentability for PCT/EP2014/068714, filed Mar. 26, 2015.
Final Office Action dated Sep. 30, 2021, for U.S. Appl. No. 16/764,930.
Response to Final Rejection and AFPilot Request for U.S. Appl. No. 16/764,930.
Notice of Allowance dated Jan. 19, 2022 for U.S. Appl. No. 16/764,930.
Final Office Action dated Feb. 22, 2021 for U.S. Appl. No. 16/317,234.
International Search Report and Written Opinion for PCT/EP2017/058672 filed Apr. 11, 2017.
Result of Examination Report for DE 10 2016 112 853.8, filed Jul. 13, 2016.
International Search Report and Written Opinion for PCT/EP2017/058667 filed Apr. 11, 2017.
Result of Examination Report for DE 10 2016 112 854.6, filed Jul. 13, 2016.
International Search Report and Written Opinion for PCT/EP2017/058668 filed Apr. 11, 2017.
Result of Examination Report for DE 10 2016 112 855.4, filed Jul. 13, 2016.
English translation of International Preliminary Examination Report for PCTEP17/058667, filed Apr. 11, 2017.
English translation of International Preliminary Examination Report for PCT/EP17/058668, filed Apr. 11, 2017.
International Preliminary Examination Report with English translation of Written Opinion for PCT/EP17/058672, filed Apr. 11, 2017.
For U.S. Appl. No. 16/317,188: Reply to Office Action dated Sep. 14, 2020.
Office Action for U.S. Appl. No. 16/317,188, dated Mar. 18, 2020.
Office Action dated Apr. 16, 2020, for U.S. Appl. No. 16/317,175.
Notice of Allowance dated Sep. 22, 2020 for U.S. Appl. No. 16/317,175.
Notice of Allowance dated Sep. 22, 2020 for U.S. Appl. No. 16/317,188.
For U.S. Appl. No. 29/679,432: Response filed Nov. 19, 2020 Final Office Action dated Dec. 2, 2020.
Youtube, XL-Boxx—The large power tool and transport case in the L-Boxx System posted by user Alexander Schweyer on Oct. 7, 2019 (https://ww.youtube.com/watch?v=A3gakVZn_y!) 2019.
Home Depot, 6"H x 14"W x 17.5"L Compartment Small Part Organizer first reviewed on Apr. 2, 2012 2012.
Office Action dated Jul. 20, 2020, for Design U.S. Appl. No. 29/679,432.
For U.S. Appl. No. 16/317,188: Response dated Jun. 1, 2020 Final Office Action dated Jun. 29, 2020.
Response to Final Office Action filed Mar. 2, 2021 for U.S. Appl. No. 29/679,432.
Chinese Office Action dated Jan. 13, 2023 for Chinese Patent Application No. 202110170420.4 (claiming priority to German Patent Application No. 10 2020 104 512).

* cited by examiner

BELT ADAPTER AND HOLDING SYSTEM COMPRISING A BELT ADAPTER AND A CARRIER ELEMENT

FIELD OF THE DISCLOSURE

The present disclosure relates to a belt adapter for attaching objects to a belt and a holding system, comprising a belt adapter and a carrier element which is disposed on an object to be attached to the belt or to the belt adapter.

BACKGROUND

To attach objects to a belt, for example, to attach tools, tool bags or tool holders, it is known from the prior art to use belt adapters or belt clips which can be attached to a belt or connected to a belt. The belt adapters serve as coupling elements between the belt and the object to be attached. For attachment to the belt adapter, the object to be attached comprises a carrier element which is inserted into and preferably releasably locked in place in a receiving opening of the belt adapter.

An example of a belt adapter, which allows attachment of an object or, more specifically, a carrying bag, to a belt, is known from the U.S. Patent Application US 2003/0141329 A1. For attachment of the belt adapter to the belt, the belt adapter has a clamping element disposed on the back side facing the belt. The belt adapter further has a receiving opening extending from an upper side of the belt adapter downwardly along the vertical axis of the belt adapter, into which receiving opening a carrier element of the object to be attached to the belt can be inserted. The carrier element is designed as a post component with a thinner shaft and a wider flangelike end which surrounds the shaft. To lock the post component, which is inserted into the receiving opening, in place, the belt adapter is fitted with a locking or securing element which engages in the post component. By means of a push button, the locking element can be disengaged, and the post component can subsequently be removed from the belt adapter.

In addition to ensuring easy and simple attachment and disengagement, it is of vital importance that the object or carrier element to be attached is securely held in place on the belt adapter. This is particularly important when belt adapters are used in manual work. Manual laborers especially have to change tools frequently and quickly. In addition, an unintended disengagement of an object attached to a belt adapter, for example, because of a jolt or because the object gets accidentally caught, must be reliably prevented. Particularly in the event that a jolt to the object attached to the belt adapter occurs, especially a jolt counter to the direction in which the carrier element of the object is inserted into the belt adapter, there is often the risk that the securing element used to secure or lock the object in place will become disengaged.

SUMMARY

Thus, one aspect of the disclosure relates to a belt adapter which ensures that a carrier element of an object to be attached to a belt or to the belt adapter is reliably locked in place. Another aspect relates to a holding system comprising a belt adapter and a carrier element which is disposed on the object to be attached to the belt or to the belt adapter.

Advantageous embodiments and expedient refinements are also disclosed.

The above-mentioned belt adapter used for attaching objects to a belt, for example, for attaching tools or (tool) bags, comprises a holding system for the attachment of the belt adapter to the belt and an opening through which a carrier element of an object to be attached to the belt adapter can be inserted into and removed from the belt adapter. The opening extends along a vertical axis of the belt adapter. The holding system is preferably and conveniently disposed on a back side of the belt adapter, with the back side facing the belt, and the opening is disposed on a front side of the belt adapter opposite to the back side. The belt adapter further comprises a securing element which can be moved between an unlocked position, in which the carrier element can be inserted into and removed from the belt adapter, and a locked position for locking the carrier element, which is inserted in the belt adapter, in a locked position.

According to the disclosure, the securing element is designed to receive at least part of the carrier element and is movably guided along the vertical axis of the belt adapter between the unlocked position and the locked position in which the carrier element inserted into the belt adapter is securely held in the locked position. More specifically, the carrier element, which is securely disposed in the locked position, cannot be removed from the belt adapter.

The securing element is preferably designed to have an elongated shape, especially in the form of safety slide which is movably guided along the vertical axis. The securing element is preferably integrally formed in one piece or designed as a single part. The securing element can be moved from the unlocked position into the locked position, preferably by moving the carrier element, which is inserted into belt adapter, from the unlocked position, i.e., the position of the carrier element in which this carrier element can be inserted into and removed from the belt adapter, into the locked position. Thus, the carrier element serves as a driving element for the securing element.

The securing element is securely held in place in the locked position, in particular, by means of a releasable catch mechanism, which prevents the securing element from being unintentionally moved into the unlocked position. Locking the securing element in place in the secured position also prevents a movement of the carrier element out of the locked position into the unlocked position, and hence an unintended removal of the carrier element from the belt adapter. Thus, locking the carrier element into the locked position takes place indirectly by locking the securing element in the locked position. By means of the securing element, the carrier element is securely held in the locked position, even when jolts impact the object attached to belt adapter along the vertical axis.

The fact that at least part of the carrier element is received by the securing element allows the carrier element to be securely disposed in the securing element. Specifically, this also ensures a defined positioning of the securing element in the belt adapter.

The securing element preferably comprises a receiving means extending along the vertical axis of the belt adapter for receiving at least part of the carrier element inserted into the belt adapter. The receiving means is, specifically, a slot-like receiving means which, as viewed along the vertical axis, is delimited at the top and at the bottom. The carrier element inserted into the receiving means preferably rests against the upper and the lower boundary of the receiving means or is at least close thereto. The described boundaries of the receiving means make it possible, on the one hand, for the carrier element to drive the securing element from the unlocked position into the locked position. On the other hand, because of the securing element which is securely held in the locked position, an unintended movement of the carrier element disposed in the delimited receiving means from the locked position into the unlocked position is prevented.

Most preferably, the receiving means has essentially the shape and size of the carrier element or is only slightly larger than the carrier element. As a result, the carrier element rests at least partly against the sides of the receiving means, preferably against all sides of the receiving means, or at least close the sides of the receiving means. In addition to the above-mentioned unintended movement of the carrier element along the vertical axis from the locked position into the unlocked position, this also prevents lateral and other movements of the carrier element. By configuring the receiving means in such a way that it conforms to the carrier element to be used, it can be ensured that only carrier elements, which are suitable for the belt adapter and which ensure that an object is reliably held in place on the belt adapter, can be inserted into the belt adapter.

Preferably, the securing element, or at least part of the securing element, is laterally guided between two guide bars extending along the vertical axis of the belt adapter and/or rests at least in part, i.e., at least with a part of the securing element, against the guide bars. In particular, the securing element is also guided between the guide bars when moving from the unlocked position into locked position and vice versa as well as in either of the two positions as such. The guide element can have guide lugs, i.e., an elevated region, on each side facing the guide bars, which guide lugs rest against the bars. In particular, on one side, the guide element can also have a plurality of guide lugs. By guiding and resting the securing element and the guide lugs, respectively, along or against the guide bars, it can be ensured that the securing element securely moves along the vertical axis of the belt adapter, especially without a lateral movement or jamming of the securing element.

In an especially advantageous embodiment, the securing element has at least one catch lug on at least one side facing the guide bars, and at least of the guide bars has a stop element for releasably engaging the securing element in the locked position. The securing element preferably has a catch lug on both sides facing the guide bars, and both guide bars have a stop element for releasably engaging the securing element in the locked position. Thus, in the locked position, the catch lugs of the securing element rest against the stop elements in such a way that a movement of the securing element into the unlocked position is prevented. In the embodiment described, it is ensured that the securing element is securely engaged in the locked position, and, as a result, the carrier element is securely held in place in the locked position, even upon impact of an external force, for example, a jolt, on the object attached to the belt adapter.

For the purpose of releasing or disengaging the securing element from the locked position, the belt adapter preferably has a first actuating element, especially a push or control button. Most preferably, the first actuating element can be actuated or moved in the direction of the vertical axis of the belt adapter. The first actuating element can be disposed in particular on an upper side of the belt adapter. The first actuating element is preferably spring-loaded, with a spring counteracting an actuation of the first actuating element. After actuation, the spring automatically moves the first actuating element back into a starting position. In an especially advantageous embodiment, the first actuating element comprises two guide elements extending along the vertical axis of the belt adapter. The securing element or at least part of the securing element can be movably guided between the guide elements and/or can at least partially, i.e., with at least part of the securing element, rest against the guide elements. In particular, the securing element can have guide lugs which rest against the two guide elements of the first actuating element. By guiding and resting the securing element and the guide lugs, respectively, along or against the guide elements of the first actuating element, it can be ensured that the securing element securely moves along the vertical axis of the belt adapter, especially without a lateral movement or jamming of the securing element.

Especially in the above-described embodiment of the belt adapter in which the securing element is guided between two guide bars extending along the vertical axis of the belt adapter and has at least one catch lug for releasably engaging the securing element in the locked position on a stop element of one of the guide bars, the securing element can be disengaged from the locked position by means of the guide elements. Preferably the securing element can have two catch lugs which each rest against a stop element of the guide bar. Upon actuation of the first actuating element, the guide elements engage between the two guide bars or, more specifically, rest against the guide bars and push them apart. In particular, one of the guide elements, in either case, rests against a guide bar, preferably against a slope of the guide bar disposed in the direction of the first actuating element. On the side facing the direction of the first actuating element, the guide bars are designed to be able to move (especially to be able to move essentially at right angles relative to the vertical axis of the belt adapter) at least to the extent that they make it possible to disengage the catch lug and/or the catch lugs of the securing element, which catch lug and/or catch lugs rests or rest against the stop element and/or the catch lugs. In the embodiment described, the preferably elongated securing element most preferably is guided both between the guide bars and between the guide elements of the actuating element. In particular, the securing element can have upper guide lugs, which rest against the guide elements, and lower guide lugs which rest against the guide bars. At the same time, the embodiment described ensures that in addition to securely guiding the securing element along the vertical axis and engaging the securing element in the locked position by means of the one or two catch lugs resting against a stop element, the securing element is easily and reliably disengaged from the locked position by means of the first actuating element.

In an advantageous embodiment of the disclosure, the securing element comprises a first spring element which counteracts a movement of the securing element from the unlocked position into the locked position. In the locked position, the first spring element is tensioned. After disengagement of the securing element from the locked position, the first spring element causes the securing element to be moved into the unlocked position, or, if the carrier element is inserted, it at least to a certain extent supports such a movement. In particular, if the securing element were to be in the locked position without insertion of a carrier element, the first spring element would cause a movement of the securing element into the unlocked position required for inserting and removing the carrier element.

In a preferred embodiment, the belt adapter comprises a case shell, in which the opening is located, and a case cover which is connected to the case shell. By means of catch connectors, the case cover is connected to the case shell preferably on the side of the case shell facing the belt. The catch connectors can be engaged, in particular, in complementary catch connector receiving means of the case shell.

The case cover preferably comprises the two above-described guide bars which extend along the vertical axis of the belt adapter, between which guide bars the securing element is movably guided and/or against which at least part of the securing element rests. In addition to allowing the individual components of the belt adapter to be easily produced, the multi-component design of the belt adapter allows a suitable, in particular, a robust construction, of the individual components. In particular, the individual components can also be made of various materials.

The holding system for attaching the belt adapter to the belt preferably comprises a holding flap which is swivel-hinged to the belt adapter, with the holding flap being held in place, especially releasably held in place, in an attachment position provided for the attachment of the belt adapter to the belt. In particular, the holding flap can be swivel-hinged to the case cover and/or the case shell of the belt adapter. More specifically, the holding flap can be connected to the case cover and/or the case shell by means of a (hinge) pin. The belt adapter, especially the case cover, most preferably comprises at least one catch element for securely holding the holding flap in the attachment position and a second actuating element for disengaging the holding flap which is securely held or engaged in the attachment position. The second actuating element is connected to the one or more catch elements or comprises the one or more catch elements. The second actuating element can be disposed especially on a bottom side of the belt adapter. In addition to allowing the belt adapter to be easily and quickly attached to and removed from the belt, the holding flap, which is swivel-hinged to the belt adapter and which can be securely held in an attachment position on the belt adapter, also ensures that the belt adapter remains securely attached to the belt.

The belt adapter or, more specifically, the individual components of the belt adapter can be made particularly of a plastic material, e.g., of polyamide 6 (PA6), acrylonitrile butadiene styrene copolymer (ABS) or polyoxymethylene (POM), and of (glass) fiber-reinforced plastic of other suitable materials. In particular, the individual components can also be made of different materials. For example, the case shell and the actuating elements can be made of ABS, the securing element can be made of POM, and the case cover and the holding flap can be made of PA6 GF15 (15% glass fiber reinforced PA6).

The opening and/or the receiving means of the securing element is/are preferably designed for inserting and receiving a carrier element in the form of a hook or a hook-shaped element. In particular, the hook-shaped carrier element can have an angled shape, especially an essentially right-angled shape as viewed from the side. The width of the hook-shaped carrier element is preferably markedly smaller than its length and its depth. In particular, the opening and the receiving means have an elongated or slot-like shape, with the length of the opening and of the receiving means in the direction of the vertical axis and the width of the opening and of the receiving means at right angles relative to the vertical axis essentially corresponding to or being only slightly greater than the length and width of the hook-shaped carrier element. For example, the hook-shaped carrier element and thus the opening and the receiving means as well can have a length of approximately 20 to 35 mm and a width of 2.5 to 5 mm. The described design of the opening and of the receiving means makes it possible to quickly and easily insert and remove the hook-shaped carrier element. In particular, because of the design of the opening and of the receiving means which conforms to the hook-shaped carrier element, it is ensured that the carrier element remains securely attached to the belt adapter.

In an especially advantageous embodiment, the belt adapter has an insertion region which surrounds the opening and which slopes downwardly in the direction of the opening. The downwardly sloping insertion region facilitates insertion of the carrier element through the opening into the belt adapter. The object to be attached to the belt adapter can rest with its contact face against the elevated edge of the downwardly sloping insertion region or, more specifically, against the elevated region surrounding the insertion region. Because the contact surface rests against the belt adapter, it is ensured that the object is further stabilized on the belt adapter.

Another aspect of the disclosure is an attachment system which, in addition to the belt adapter of the disclosure, also comprises a carrier element which is disposed on an object to be attached to the belt or to the belt adapter, with the carrier element, which is inserted into the belt adapter, moving the securing element from the unlocked to the locked position. The object to be attached to the belt or to the belt adapter can, in particular, be a tool, a tool bag or a tool holder. The carrier element disposed on the object can, in particular, have the shape of a hook. The advantages mentioned in the context of the above-described belt adapter apply mutatis mutandis to the attachment system of the disclosure.

BRIEF DESCRIPTION OF THE DRAWINGS

These and other features and advantages and effects of the belt adapter of the disclosure and of the attachment system follow from the embodiment example further described below with reference to the attached drawings. The drawings show.

DETAILED DESCRIPTION

Figure 7:
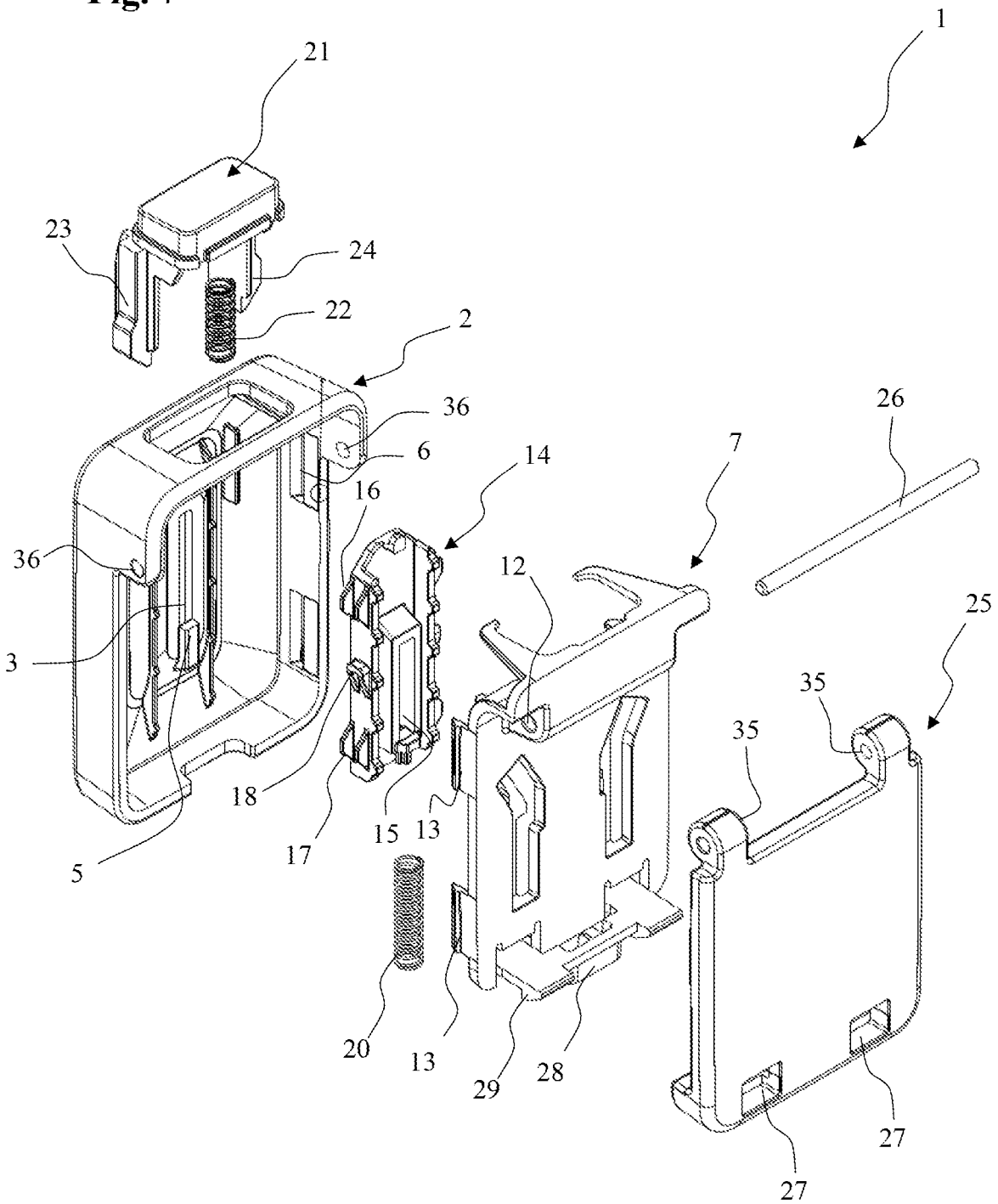
FIG. 7 an exploded view of the belt adapter shown in FIG. 1.
Figure 8:
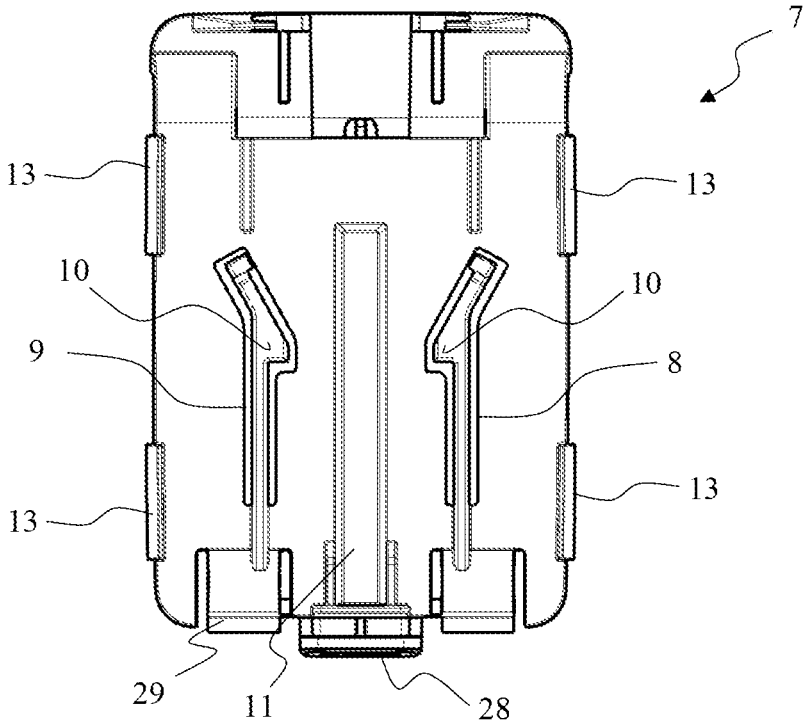
FIG. 8 a front view of a case cover of the belt adapter shown in FIG. 1.
Figure 9:
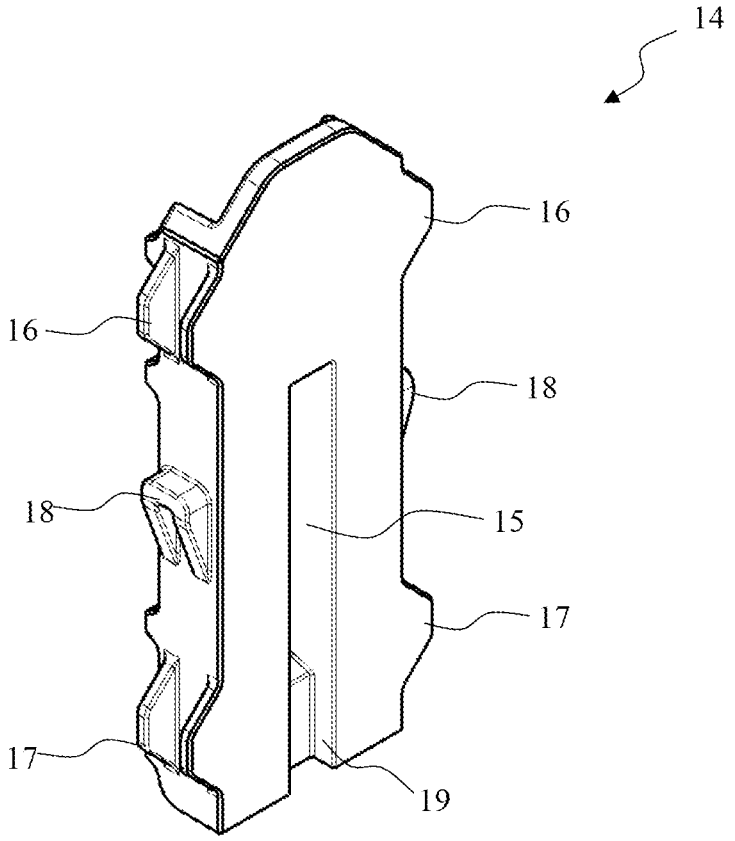
FIG. 9 a perspective view of a securing element of the belt adapter shown in FIG. 1.
Figure 10:
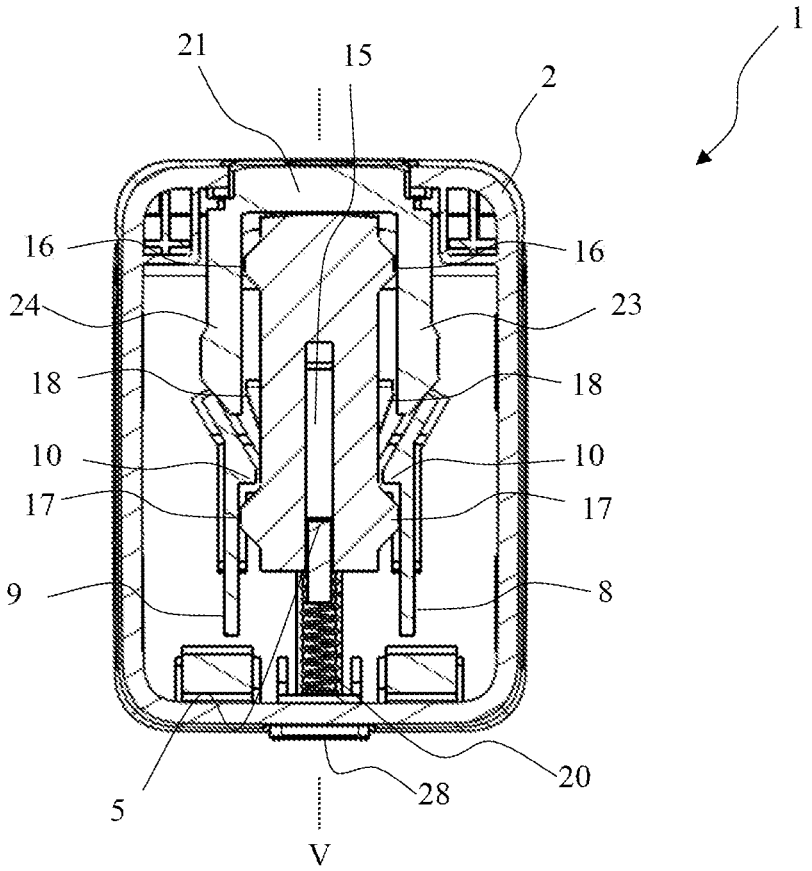
FIG. 10 a section along the vertical axis of the belt adapter of FIG. 1 in the view shown in FIG. 2 in the area of the securing element, with the securing element in the unlocked position.
Figure 11:
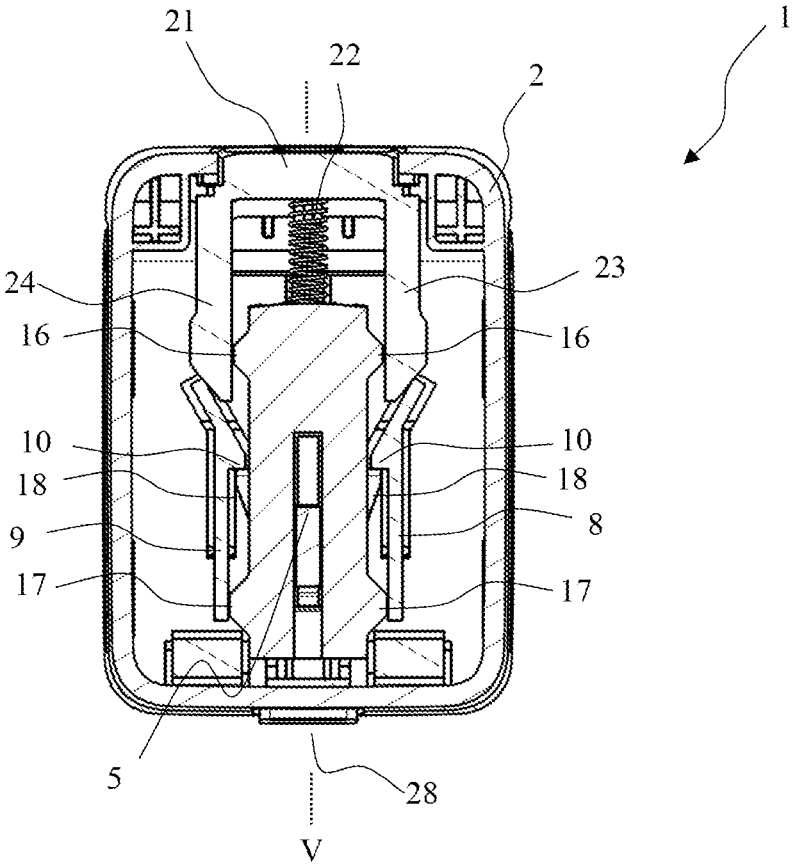
FIG. 11 same as FIG. 10, with the securing element in the locked position.
Figure 12:
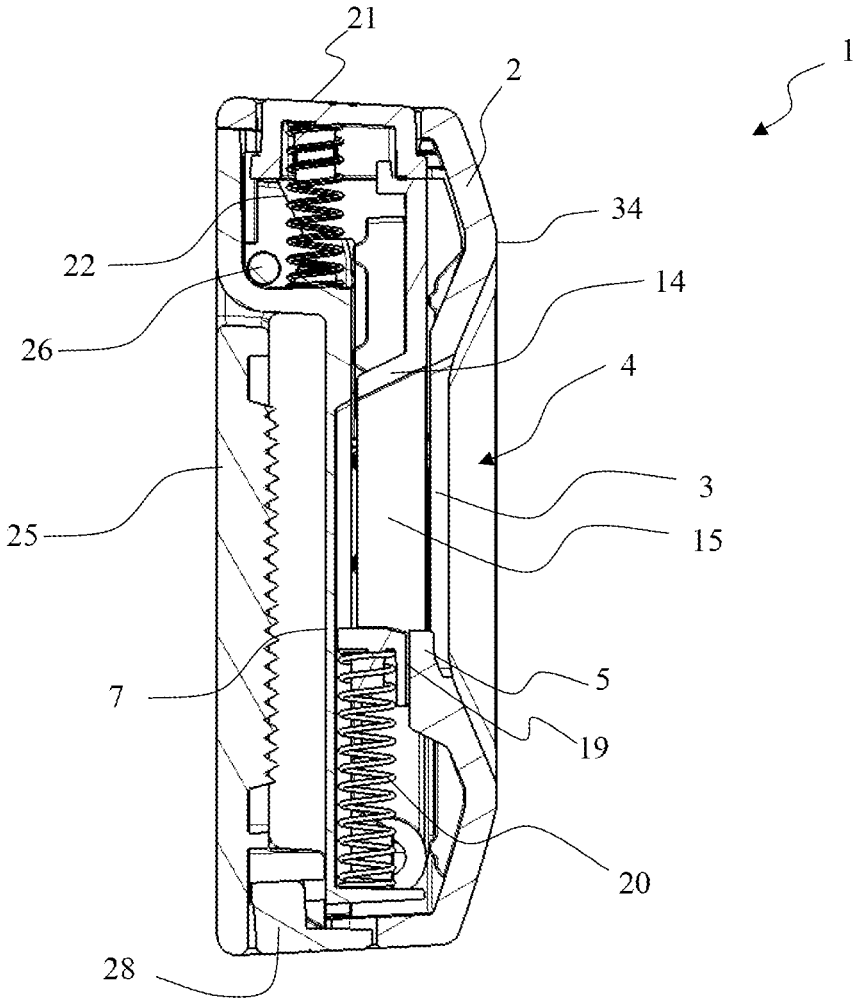
FIG. 12 a section along the vertical axis of the belt adapter of FIG. 1 in the view shown in FIG. 4 in the area of the opening.
Figure 13:
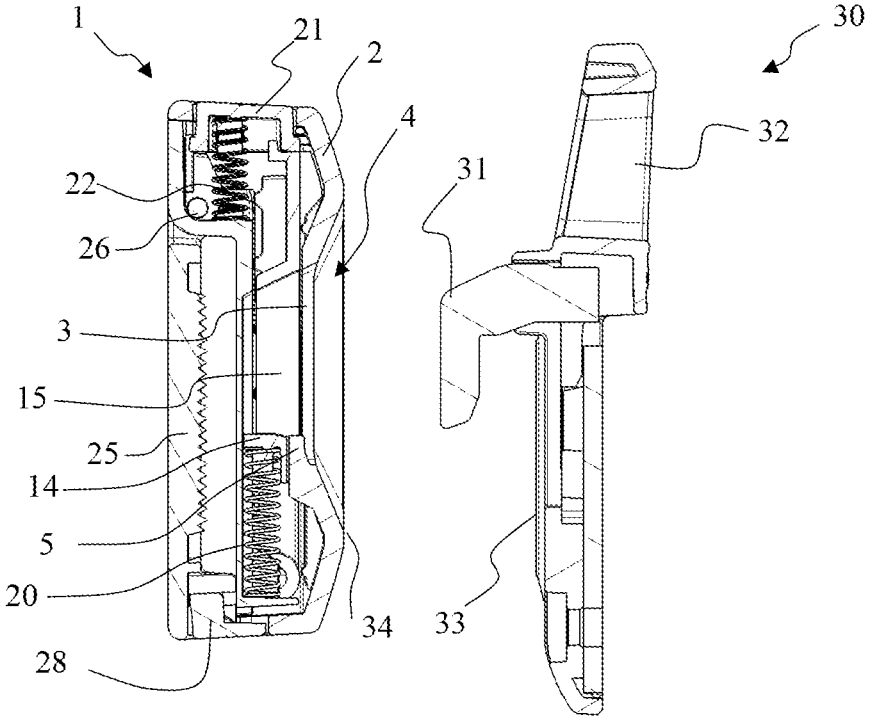
FIG. 13 a section through the belt adapter of FIG. 1 along the vertical axis in the view shown in FIG. 4 in the area of the opening and a section through an object to be attached to the belt adapter in the area of the carrier element.
Figure 14:
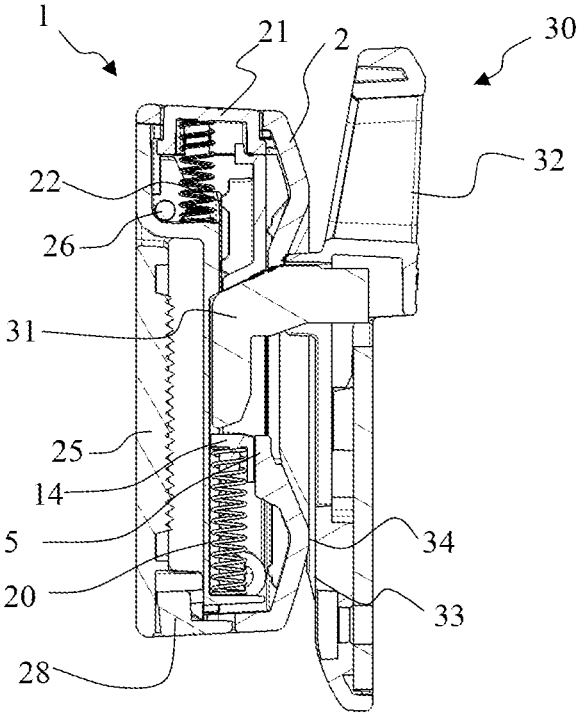
FIG. 14 same as FIG. 13, with the carrier element being in the unlocked position.
Figure 15:
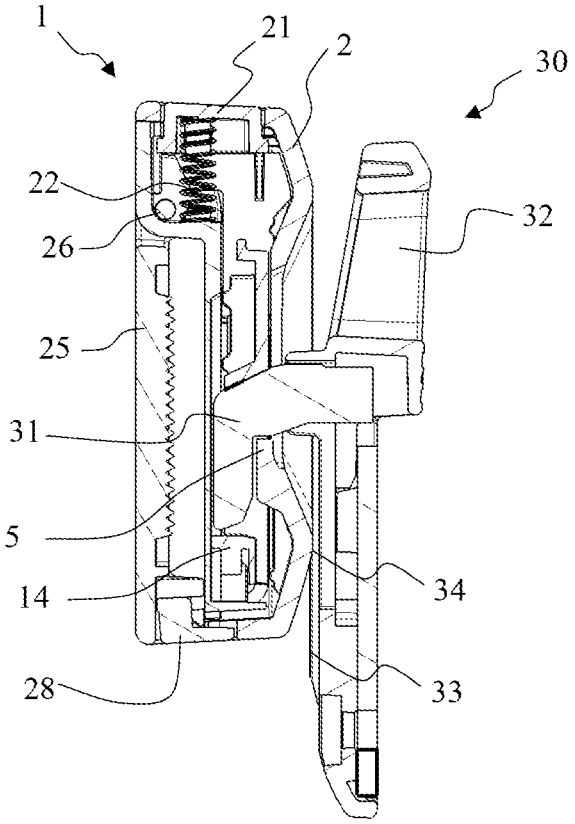
FIG. 15 same as FIG. 13, with the carrier element being in the locked position.

FIGS. 1 to 6 show different views of an embodiment example of a belt adapter 1 of the disclosure used for attaching objects to a belt, FIG. 7 shows an exploded view, and FIGS. 10 to 12 show sectional views. FIGS. 8 and 9 show individual components of the belt adapter 1. FIGS. 13 to 15 show sectional views to illustrate how an object is attached to the belt adapter 1.

As can be seen particularly from FIG. 7, the belt adapter 1 comprises a case shell 2 on its front side facing away from a belt and intended for attachment of an object, a case cover 7 disposed on the side of the case shell 2 facing the belt, and a holding flap 25 disposed on the side of the case cover 7 facing away from the case shell 2. The case cover 7 can be connected to the case shell 2 by means of two catch connectors 13, each of which are disposed on each side of the case cover 7 and which can be engaged in a catch connector receiving means 6 of the case shell 2. FIG. 8 shows the side of the case cover 7 oriented in the direction of the case shell 2.

Disposed between the case shell 2 and the case cover 7 is a securing element 14, described in greater detail below and shown separately in FIG. 9. The securing element 14 serves to securely hold a carrier element 31 of an object to be attached to the belt adapter 1 in a locked position, which carrier element can be inserted into the belt adapter 1. On the top face, hereinafter referred to as the top side, of the belt adapter 1, as viewed along the vertical axis V of the belt adapter 1 shown in FIG. 1, the belt adapter 1 has a first actuating element 21. The first actuating element 21 allows the securing element 14 to be disengaged, as described in greater detail below, from a locked position of the securing element 14, which locked position securely holds the carrier element 31 in the locked position.

The holding flap 25 disposed on the case cover 7 is swivel-hinged to the case shell 2 and to the case cover 7 and swivel-connected thereto by means of a (hinge) pin 26. To this end, the pin 26 is inserted into and guided in two bores 36 of the case shell 2, as shown in FIG. 7, in a pin receiving means 12 of the case cover 7, and in two external sections 35 of the pin receiving means of the holding flap 25, which can be disposed or are disposed on the side of the pin receiving means 12. Between the holding flap 25 and the case cover 7, the belt to which the belt adapter 1 is to be attached can be inserted or, depending on the thickness of the belt, clamped in. On the side facing the case cover 7, the holding flap 25 has spikes or, at least in certain regions, a spiked surface, which can engage in an inserted belt, thereby improving the secure attachment of the belt adapter 1 to the belt. For securely holding the holding flap 25 in the locked position in which the holding flap rests against the case cover 7, the case cover 7 has a catch element 29 which can be engaged in complementary catch element receiving means 27 of the holding flap 25. The catch element 29 is an integral part of a second actuating element 28 which is disposed on a bottom face of the belt adapter 1 as shown especially in FIG. 6. By actuating the second actuating element 28, more specifically, by pushing the actuating element 28 upwardly along the vertical axis V of the belt adapter 1, the catch element 29 is disengaged from the catch element receiving means 27 of the holding flap 25. The second actuating element 28 is preferably spring-loaded. After actuation, the second actuating element 28, and therefore, due to the spring-loaded design, along with it, the catch element 29 as well, is moved into the starting position in which it is when engaged in the catch element receiving means 27.

Figure 1:
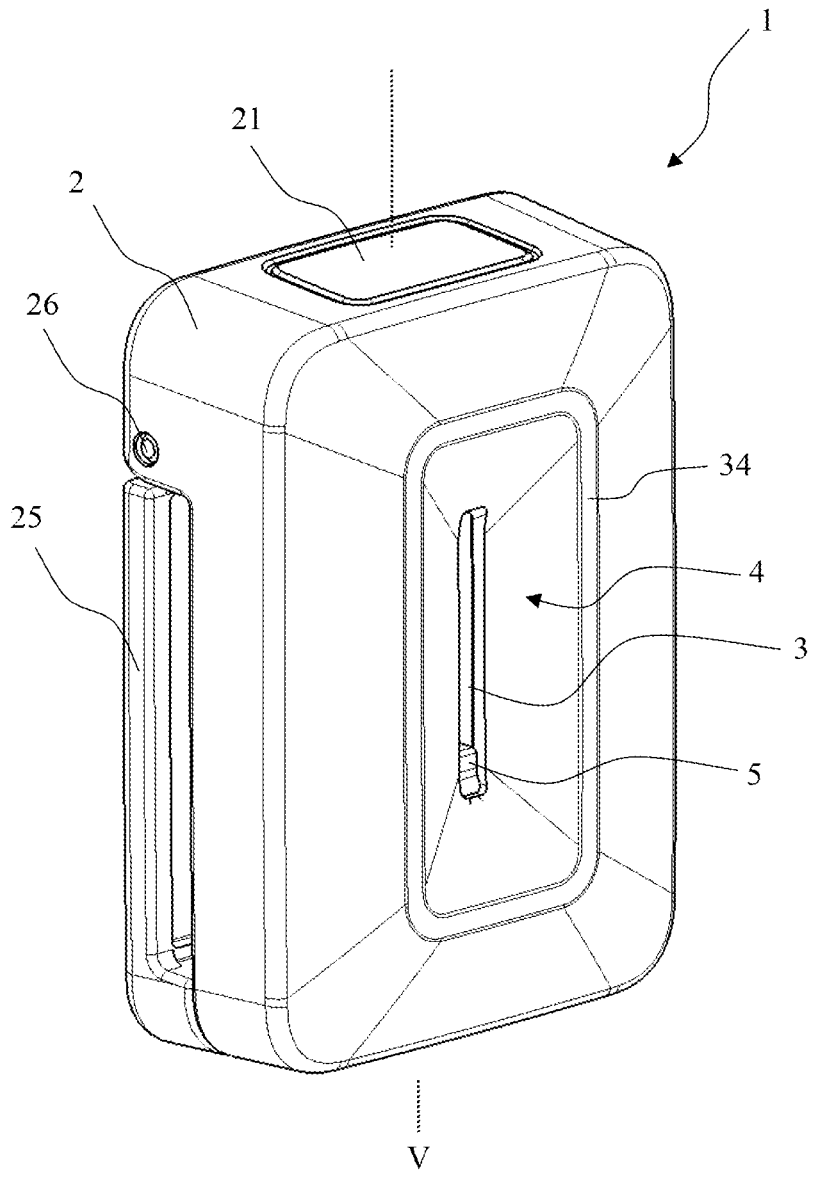
FIG. 1 a perspective view of a belt adapter of the disclosure.
Figure 2:
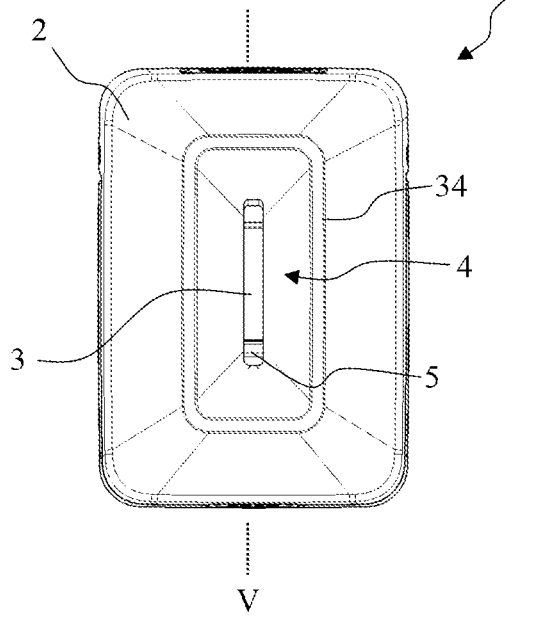
FIG. 2 front view of the belt adapter shown in FIG. 1.
Figure 3:
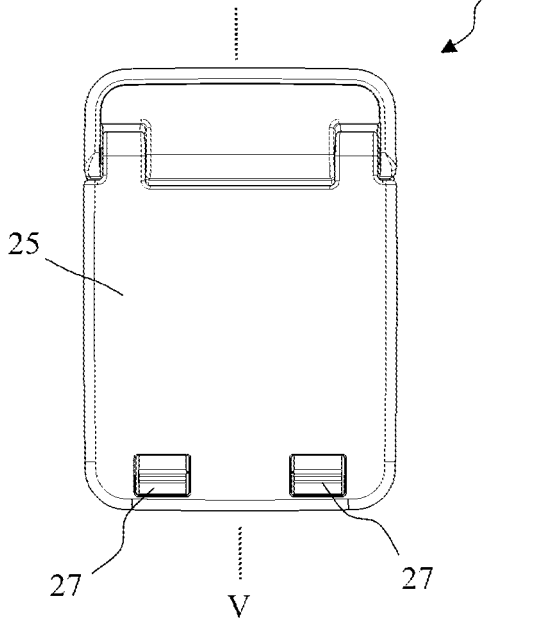
FIG. 3 a rear view of the belt adapter shown in FIG. 1.
Figure 4:
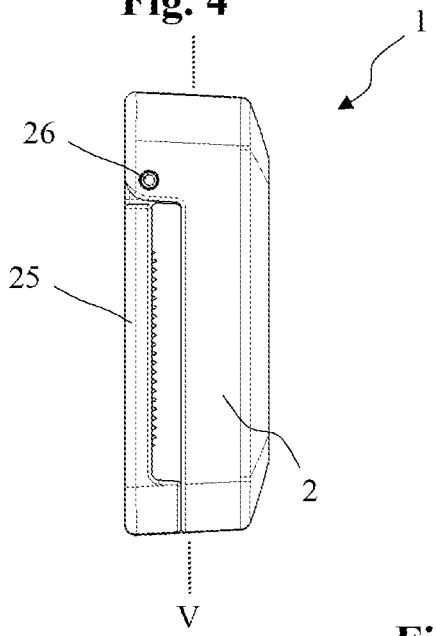
FIG. 4 a side view of the belt adapter shown in FIG. 1.
Figure 5:
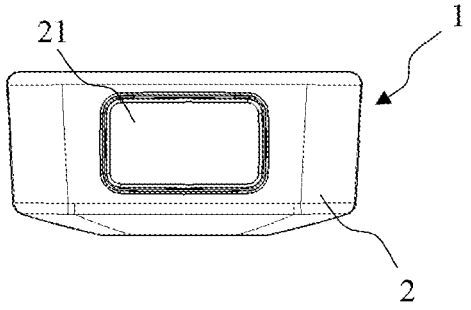
FIG. 5 a plan view of the belt adapter shown in FIG. 1.
Figure 6:
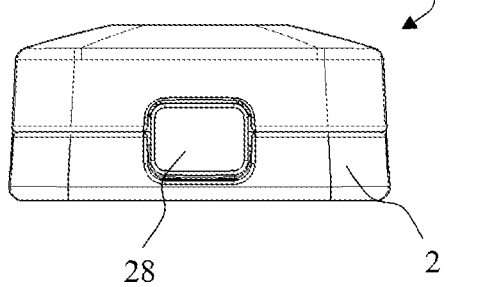
FIG. 6 a bottom view of the belt adapter shown in FIG. 1.

For insertion of a carrier element 31 into the belt adapter 1, the case shell 2 has a slot-like opening 3 which extends along the vertical axis V of the belt adapter 1. In the area around the opening 3, the case shell 2 has an insertion region 4 which is sloped downwardly in the direction of the opening 3 and which facilitates insertion of the carrier element 31 into the opening 3. The insertion region 4 is delimited by an elevated region 34 of the case shell 2 which surrounds the insertion region 4. The opening 3 in the case shell 2, as especially shown in FIG. 1, is delimited along the sides and on the top and bottom by the case shell 2 itself, with the case shell 2 having a positioning edge 5 on the lower end of the opening 3.

The elongated securing element 14, the individual components of which are separately shown in FIG. 9, has a slot-like receiving means 15 which extends along the vertical axis V of the belt adapter 1 and which is delimited at the top and bottom and along the sides. The receiving means 15 serves to receive at least part of the carrier element 31 which is inserted into the belt adapter 1 through the opening 3 of the case shell 2. The securing element 14 can be moved along the vertical axis V of the belt adapter 1 between an unlocked position, as shown in the sectional views of FIGS. 10 and 12, in which the carrier element 31 can be at least partially inserted into and removed from the receiving means 15 of the securing element 14 through the opening 3, and a locked position shown in FIG. 11, in which the inserted carrier element 31 is securely held in a locked position. By analogy to the locked position, the position, in which the carrier element 31 is inserted into the securing element 14 in the belt adapter 1 when the securing element is in the unlocked position, is referred to as the unlocked position. As shown in FIG. 9, on the lower end of the securing element 14, the securing element has a recess 19 which, when the securing element 14 is in the unlocked position, rests against the inside surface of the positioning edge 5 of the case shell 2, which inside surface faces the direction of the securing elements 14, as is illustrated in particular in FIG. 12.

For securely guiding the securing element 14 along the vertical axis V, the securing element 14 on each side has an upper guide lug 16 and a lower guide lug 17. The lower guide lugs 17 rest against two guide bars 8, 9, a first guide bar 8 and a second guide bar 9, of the case cover 7 which guide bars extend along the vertical axis V. More specifically, the lower guide lugs 17 rest against the inside surfaces of the guide bars 8, 9, with the inside surfaces of the guide bars facing each other. The guide bars 8, 9 disposed on the case cover 7 can be seen especially in the diagrammatic representation of the case cover 7 shown in FIG. 8 and in the sectional views of the belt adapter 1 shown in FIG. 10 and FIG. 11. The upper guide lugs 16 of the securing element 14 are guided by means of a first and second guide element 23, 24 of the first actuating element 21, which guide elements extend along the vertical axis V. As shown in FIG. 10 and FIG. 11, the upper guide lugs 16 rest against the inside surfaces of the guide elements 23, 24, which inside surfaces face each other. The upper and the lower guide lugs 16, 17 also rest against the guide elements 23, 24 and the guide bars 8, 9 so as to be able to move when the securing element 14 is moved from the unlocked position shown in FIG. 10 into the locked position shown in FIG. 11 and when it is moved back into the unlocked position.

A first spring element 20, especially a compression spring, which is connected to the securing element 14 and which rests against the case cover 7, counteracts a movement of the securing element 14 from the unlocked position shown in FIG. 10 into the locked position shown in FIG. 11. For reasons of better illustration, the tensioned first spring element 20 is not shown in FIG. 11.

For securely holding the carrier element 31, which is inserted into the belt adapter 1 and especially into the receiving means 15 of the securing element 14, in the locked position, the securing element 14 has each a catch lug 18 disposed between the upper and the lower guide lugs 16, 17. In the locked position of the securing element 14, the catch lugs 18, as shown in FIG. 11, rest against a stop element 10 of the guide bars 8, 9, which causes the securing element 14 to be engaged in the locked position. The stop elements 10 and the catch lugs 18 acting on the stop elements 10 prevent an unintended movement of the securing element 14 into the unlocked position and thus also an unintended movement of a carrier element 31, which is inserted into the receiving means 15, from the locked position into the unlocked position.

The securing element 14 is disengaged from the locked position shown in FIG. 11 by means of the first actuating element 21. In the starting position of the first actuating element 21, as shown in FIG. 10 and FIG. 11, the guide elements 23, 24 rest against the guide bars 8, 9, more specifically on a slope of the guide bars 8, 9 which, in the direction of the guide elements 23, 24, is disposed above and on the stop elements 10. Actuating or pushing the first actuating element 21 downwardly along the vertical axis V in the direction of the guide bars 8, 9 causes the guide elements 23, 24 to slide along the slopes of the guide bars 8, 9 and to push against these slopes. On the sloped side, the guide bars 8, 9 are designed to be movable at least to the extent that they allow the catch lugs 18 of the securing element 14, which rest against the stop elements 10, to be disengaged by the action of the guide elements 23, 24. Specifically, the stop elements 10 are moved outwardly essentially at right angles to the vertical axis V, which has the effect that the catch lugs 18 no longer rest against the stop elements 10. By means of the first spring element 20 and/or an active upward movement of the object or the carrier element 31, which is attached to the belt adapter 1, along the vertical axis V, the securing element 14 can be moved into the unlocked position. To move the first actuating element 21 back into the starting position shown in FIG. 10 and FIG. 11, the first actuating element 21 is connected to a second spring element 22 which rests against the case cover 7, as is illustrated especially in FIG. 12.

FIG. 12 shows a section along the vertical axis V through the lateral view of the belt adapter 1 along the opening 3, and FIGS. 13 to 15 illustrate how a carrier element 31, which is disposed on an attachment adapter 30 of an object to be attached to the belt adapter 1, is inserted. The attachment adapter 30 can, for example, be an integral part of a tool bag with the bag disposed on the side facing away from the carrier element 31 or an integral part of a tool itself. To facilitate handling, the top portion of the attachment adapter 30 has a handle 32 to be gripped by one or more fingers. The carrier element 31 of the attachment adapter 30 has a hook-shaped design, especially an angled shape as viewed from the side.

To attach the attachment adapter 30 to the belt adapter 1, the carrier element 31 shown in FIG. 13 is inserted through the opening 3 into the belt adapter 1. Insertion of the carrier element 31 is possible only when the securing element 14 is in the unlocked position. The securing element 14 or, more specifically, the receiving means 15 of the securing element 14 receives at least part of the carrier element 31 which is inserted into belt adapter 1, as shown in the unlocked position of the carrier element 31 in FIG. 14. The receiving means 15 has essentially the shape of the carrier element 31 or is only slightly larger than the carrier element. In particular, the carrier element 31 inserted into the receiving means 15 rests against or close to the sides and, as shown in FIG. 14, the top and bottom faces of the securing element 14 which delimit the receiving means 15. On the front side oriented in the direction of the case cover 7, the carrier element 31 rests against a recess 11 of the case cover 7 extending along the vertical axis V as shown in FIG. 8. The securing element 14 (or, more specifically, the areas of the securing element 14 surrounding the receiving means 15 of the securing element 14) and the recess 11 of the case cover 7 ensure that the carrier element 31 inserted into the belt adapter 1 is disposed in a clearly defined position in the belt adapter 1. To securely hold the carrier element 31 in the belt adapter 1, the carrier element 31 (or, more specifically, the attachment adapter 30 as a whole) is moved downwardly along the vertical axis V relative to the belt adapter 1 from the unlocked position shown in FIG. 14 into the locked position. Depending on the weight of the attached object and the spring force of the first spring element 20, the movement of the carrier element 31 into the locked position can possibly also be caused by the attached object itself. The carrier element 31, which rests against the bottom end of the receiving means 15 of the securing element 14, serves as a driving element for the securing element 14, with the securing element 14 being moved along the vertical axis V from the unlocked position shown in FIG. 14 into the locked position shown in FIG. 15. The downward movement of the carrier element 31 is limited by the positioning edge 5 of the opening 3, as also illustrated by the locked position shown in FIG. 15 in which the carrier element 31 is shown to rest against the positioning edge 5. An unintended movement of the carrier element 31 from the locked position into the unlocked position is prevented by the securing element 14 which is engaged in the locked position. Thus, it is not possible for the carrier element 31, which is securely held in the locked position, to be removed from the belt adapter 1.

To further stabilize the attachment adapter 30 disposed on the belt adapter 1, a contact face 33 of the attachment adapter 30 rests against the case shell 2, more specifically, against the elevated region 34 of the case shell 2 which surrounds the insertion region 4.

To remove the carrier element 31, which is securely held in the locked position, from the belt adapter 1, the catch mechanism of the securing element 14 engaged in the locked position is disengaged, as described above, by means of the first actuating element 21. The tensioned first spring element 20, which, solely for reasons of clarity, is not shown in FIG. 15, supports, at least to a certain extent, a movement of the securing element 14 in the direction of the unlocked position. However, if the object attached to the belt adapter 1 is heavy, application of external force is required to move the carrier element 31 from the locked position into the unlocked position. To actuate the first actuating element 21 and at the same time to move the carrier element 31 or, more specifically, the attachment adapter 30 upwardly, the design of the attachment adapter 30, with the handle 32 disposed on the upper portion as shown in FIGS. 13 to 15, is particularly advantageous. For example, to move the attachment adapter 20 upwardly, two fingers can engage the handle 32, and the first actuating element 21 can be simultaneously actuated by the thumb of the same hand. The upward movement of the carrier element 31 also causes the securing element 14 to be moved from the locked position into the unlocked position. The carrier element 31 disposed in the unlocked position shown in FIG. 14 can be subsequently removed from the belt adapter 1.

Because of the described design of the belt adapter 1, the carrier element 31 inserted into the belt adapter 1 is reliably and securely held in the locked position. More specifically, the described design of the belt adapter 1 reliably prevents an unintended disengagement of the carrier element 31 from the locked position, even if an external force were to be exerted in the direction along the vertical axis V. In addition, a lateral movement of the carrier element 31 relative to the vertical axis V or any other movement, e.g., a twisting movement of the carrier element 31, is prevented or at least largely limited by the receiving means 15 of the securing element 14 which conforms to a specific carrier element 31. Thus, the belt adapter 1 described ensures that the carrier element 31 remains securely attached to the belt adapter.

LIST OF REFERENCE CHARACTERS

1 Belt attachment device
2 Case shell
3 Opening
4 Insertion region
5 Positioning edge
6 Catch connector receiving means
7 Case cover
8 First guide bar
9 Second guide bar
10 Stop element
11 Recess
12 Pin receiving means
13 Catch connectors
14 Securing element
15 Receiving means
16 Upper guide lugs
17 Lower guide lugs
18 Catch lug
19 Recess
20 First spring element
21 First actuating element
22 Second spring element
23 First guide element
24 Second guide element
25 Holding flap
26 Pin
27 Catch element receiving means
28 Second actuating element
29 Catch element
30 Attachment adapter
31 Carrier element
32 Handle
33 Contact face
34 Elevated region
35 Section of the pin receiving means
36 Bore
V Vertical axis

What is claimed is:

1. A belt adapter for attaching an object to a belt, the belt adapter comprising a holding system for attaching the belt adapter to the belt, an opening elongated in a direction of a vertical axis of the belt adapter, through which opening a carrier element of the object is insertable horizontally into the belt adapter, and a securing element which is movable between an unlocked position, in which the carrier element is insertable into and removed from the belt adapter, and a locked position for securely holding the carrier element inserted into the belt adapter in a locked position, wherein the securing element is configured to receive at least part of the carrier element and is movably guided in the direction of the vertical axis of the belt adapter between the unlocked position and the locked position in which the carrier element inserted into the belt adapter is securely held in the locked position; and wherein the securing element includes a receiving element formed as a slot and delimited at horizontal ends, the receiving element elongated in the direction of the vertical axis of the belt adapter and configured for receiving the at least part of the carrier element inserted into the belt adapter.

2. The belt adapter according to claim 1, wherein movement of the securing element is guided between two guide bars preventing lateral movement of the securing element, the two guide bars extending in the direction of the vertical axis of the belt adapter and/or the securing element rests at least in part against the two guide bars.

3. The belt adapter according to claim 2, wherein the securing element further includes at least one catch lug at least on one side facing the two guide bars and wherein at least one of the two guide bars has a stop element configured for releasably engaging the securing element in the locked position.

4. The belt adapter according to claim 1, wherein a first actuating element is actuatable in the direction of the vertical axis of the belt adapter, the first actuating element configured to disengage the securing element when the securing element is engaged in the locked position.

5. The belt adapter according to claim 4, wherein the first actuating element comprises two guide elements extending in the direction of the vertical axis of the belt adapter, the securing element being movably guided between the two guide elements, and/or the securing element rests at least in part against the two guide elements.

6. The belt adapter according to claim 1, wherein movement of the securing element is guided between two guide bars extending in the direction of the vertical axis of the belt adapter and the securing element has at least one catch lug configured for releasably engaging the securing element in the locked position with at least one stop element of one of the two guide bars, and wherein the belt adapter comprises a first actuating element with two guide elements extending in the direction of the vertical axis of the belt adapter, with the guide elements being designed to disengage the securing element engaged in the locked position on actuation of the first actuating element.

7. A belt adapter for attaching an object to a belt, the belt adapter comprising:

a holding system for attaching the belt adapter to the belt, an opening elongated in a direction of a vertical axis of the belt adapter, through which opening a carrier element of the object is insertable into the belt adapter, and a securing element which is movable between an unlocked position, in which the carrier element is insertable into and removed from the belt adapter, and a locked position for securely holding the carrier element inserted into the belt adapter in a locked position, wherein the securing element is designed to receive at least part of the carrier element and is movably guided in the direction of the vertical axis of the belt adapter between the unlocked position and the locked position in which the carrier element inserted into the belt adapter is securely held in the locked position, wherein movement of the securing element is guided between two guide bars extending in the direction of the vertical axis of the belt adapter and the securing element has at least one catch lug for releasably engaging the securing element in the locked position with at least one stop element of one of the guide bars, wherein the belt adapter comprises a first actuating element with two guide elements extending in the direction of the vertical axis of the belt adapter, with the guide elements being designed to disengage the securing element engaged in the locked position on actuation of the first actuating element, wherein upon actuation of the first actuating element, one of the guide elements rests against one of the guide bars, and wherein the guide elements push the guide bars apart.

8. The belt adapter according to claim 1, wherein a first spring element is connected to the securing element, the first spring element configured for counteracting a movement of the securing element from the unlocked position into the locked position.

9. The belt adapter according to claim 1, further comprising a case shell with the opening and a case cover connected to the case shell, the case cover comprising two guide bars extending in the direction of the vertical access of the belt adapter, between which movement of the securing element is guided and/or the securing element rests at least in part against the guide bars.

10. The belt adapter according to claim 1, wherein the holding system for attaching the belt adapter to the belt comprises a holding flap which is swivel-hinged to the belt adapter, in particular a holding flap which is swivel-hinged to a case cover and/or a case shell of the belt adapter, the holding flap being securely held in an attachment position for attaching the belt adapter to the belt.

11. The belt adapter according to claim 10, wherein the belt adapter comprises at least one catch element for engaging the holding flap in the attachment position and a second actuating element disposed on a bottom face of the belt adapter, which is connected to the at least one catch element and/or which comprises the at least one catch element.

12. The belt adapter according to claim 1, wherein the opening and/or the receiving element of the securing element is configured for inserting and receiving a carrier element formed in a shape of a hook.

13. The belt adapter according to claim 1, wherein an insertion region surrounds the opening and slopes downwardly in a direction of the opening.

14. The belt adapter according to claim 2, wherein the securing element has at least one catch lug on both sides facing the two guide bars, and wherein both guide bars have a stop element for releasably engaging the securing element in the locked position.

15. A holding system, comprising the belt adapter according to claim 1 and a carrier element which is disposed on an object to be attached to the belt and/or the belt adapter, wherein the securing element can be moved by the carrier element inserted into the belt adapter from the unlocked position into the locked position.

16. The holding system according to claim 15, wherein the object is at least one of a tool, a tool bag, and a tool holder.

* * * * *